US006113147A

United States Patent [19]

Johnson

[11] Patent Number: 6,113,147

[45] Date of Patent: Sep. 5, 2000

[54] REFORMATTING PRINTED AND ELECTRONIC TEXT FOR SMOOTHER READING

[76] Inventor: Gary R Johnson, P.O. Box 824, Boise, Id. 83701

[21] Appl. No.: 08/935,005

[22] Filed: Sep. 22, 1997

[51] Int. Cl.[7] ..... B42D 15/00

[52] U.S. Cl. ..... 283/62; 283/45; 283/46; 434/156; 434/167; 434/178; 434/179

[58] Field of Search ..... 283/62, 45, 46; 434/156, 178, 179, 167

[56] References Cited

U.S. PATENT DOCUMENTS

| | | | |
|---|---|---|---|
| 1,122,110 | 12/1914 | Hansen | 283/45 |
| 4,078,319 | 3/1978 | Mazeski et al. | 434/178 |
| 5,033,964 | 7/1991 | Phelps | 434/178 |
| 5,182,709 | 1/1993 | Makus . | |
| 5,474,456 | 12/1995 | Paiken | 434/178 |
| 5,579,224 | 11/1996 | Hirakawa et al. . | |
| 5,649,234 | 7/1997 | Klappert et al. . | |
| 5,651,678 | 7/1997 | Phillips | 434/178 |

FOREIGN PATENT DOCUMENTS 1045731 10/1990 China .

OTHER PUBLICATIONS

Diamond, Jared, Discover, The Case of the Vagrant Birds–or, Left Coast, Here We Come, p 82–84, Jan. 1986.

Sawaie, Mohammed, Arabic Phonology & Script: An Introduction, p 19 & 29, Jun. 1984.

*Primary Examiner*—Andrea L. Pitts
*Assistant Examiner*—Monica S. Carter
*Attorney, Agent, or Firm*—Ormiston & McKinney, PLLC

[57] ABSTRACT

While leaving the spelling of words intact the sequence of words on ever other line of print text is reversed. The reader reads the first line of text from left to right. When finished with the first line the reader drops her/his eyes directly below to the 'beginning' of the second line and reads the words on the second line right to left. When finished with the second line the reader again drops her/his eyes directly below to the 'beginning' of the third line and reads this line left to right. The reader continues reading alternately lines of text right to left, left to right until reaching a major break in the composition when the process is begun anew.

4 Claims, No Drawings

REFORMATTING PRINTED AND ELECTRONIC TEXT FOR SMOOTHER READING

A. BRIEF SUMMARY OF THE INVENTION

Horizontally structured text is normally read one line at a time from left to right beginning at the top. At the end of each line the reader disconnects the brain and eyes, returns the brain and eyes to the beginning of the next line, and reconnects with the first word on that line. The extra weight on the brain and eyes caused by one disconnect-reconnect interruption per line of reading slows and strains the reader.

One exception to the above is the so-called speed reader. A speed reader is trained to perceive a broader expanse of words than can the normal reader. Although technically the speed reader is reading more top to bottom than left to right, the brain is generally organizing the input information line by line, left to right, for this is how the text is coherently represented. A capable speed reader, therefore, has none or much less of the brain/eyes interruptions described in the first paragraph. However, inasmuch as speed reading techniques are not easily adopted, the large majority of persons have not and probably will not acquire speed reading capability.

A better approach—the one embodied in the present invention—is not to train persons to overcome an inhibiting structure, but to alter the structure itself. With the advent of word processing capability, personal computers, and character-recognition computer technology, restructuring of traditionally structured text for smoother reading becomes technically and economically feasible as well as culturally imperative, as explained in the Detailed Description section of this filing.

The present invention contained herein eliminates the brain/eyes disconnect-reconnect interruption experienced by the reader at the end of each line of traditionally structured text. It does so by reversing the sequence of words on every other line of text thereby permitting a continuous reading flow. This different new reading format is quickly grasped by beginning or capable readers of any age.

THE FOLLOWING PARAGRAPH IS A REFORMATION OF THE PREVIOUS PARAGRAPH IN TERMS OF THE PRESENT INVENTION

The present invention contained herein eliminates the brain/eyes disconnect-reconnect interruption reversing by so does It text structured traditionally of line each of end the at reader the by experienced the sequence of words on every other line of text thereby permitting a continuous reading flow.

.age any of readers capable or beginning by grasped quickly is format reading new different This

B. DETAILED DESCRIPTION OF THE INVENTION

These are complex times with rapid turnover of technologies and social conventions. The emerging global culture is one based on and driven by computers, information, and knowledge. More and more opportunities interfacing with these components are opening up and competition among applicants worldwide is heating up. In this dynamic and unchartered environment motivation and discipline for continuous serious reading and study, beginning in early ages, are critical factors for success.

Unfortunately, there are several powerful forces impeding personal and social progress in the direction sketched above, including:

(1) Discretionary time is being compressed by the growing severity of survival economics which is forcing more persons, many with multiple temporary or part-time jobs and possible school, into the workforce at or around subsistence wages;

(2) To cope with the economic realities of life the pace of activity for many persons has speeded up to the point of their being constantly hurried and harried, and they carry within them the potential for psychological or physical destruct.

(3) Tired Eyes Syndrome is becoming more common as larger numbers of students and workers, out of necessity, are spending longer hours gazing into computer screens, plus after-hours time surfing the Net and playing video games; and (4) The addictive properties of television and computer surfing and games wile away free time and subtly undermine many person's verve for discipline and hard work. Research studies with students, for example, show a strong correlation between higher television consumption and lower school grades.

By making reading smoother, faster, and less tiring the present invention hopes to counter these impediments to human development by strengthening two bedrock elements of a civilized people: widespread literacy with resultant awareness. Early readers and older children would skip through printed and electronic text with the lightness of play. Young adults would dance lyrically over assigned and elective reading and want for more. Adults would be magically pulled towards required and recreational reading and find the right balance with printed and electronic media. And, sight-impaired persons would find esteem and happiness in reading large format printed and electronic text as their pace and output zoom.

What is claimed is:

1. A method of formatting horizontally structured printed and electronic text, comprising:

reversing the word sequence on a second line of the text and every other line thereafter so the reader when finished reading a first line from left to right drops his/her eyes directly below to begin reading the second line from right to left, continuing in this alternating fashion of reading left to right, right to left until finished reading all lines of the text; and arranging all letters in each word form left to right in all lines of text.

2. The method according to claim 1, further comprising the step of orienting the letters the same way in all lines of text.

3. Horizontally structured printed and electronic text, comprising a first line of text in which the word sequence is left to right followed by a second line of text in which the word sequence is right to left and all letters are in each word are arranged from left to right in both lines of text.

4. The text according to claim 3, wherein the letters are oriented the same way in both lines of text.

* * * * *

UNITED STATES PATENT AND TRADEMARK OFFICE

CERTIFICATE OF CORRECTION

PATENT NO. : 6,113,147

DATED : September 5, 2000

INVENTOR(S) : Gary R. Johnson

It is certified that error appears in the above-identified patent and that said Letters Patent are hereby corrected as shown below:

As stated in the application, please correct column 1, lines 48-55 to read as follows.

The present invention contained herein eliminates the brain/eyes disconnect-reconnect interpretation reversing by so does It .text structured traditionally of line each of end the at reader the by experienced the sequence of words on every other line of text thereby permitting a continuous reading flow. This .age any of readers capable or beginning by grasped quickly is format reading new different

<u>In the Claims</u>

Column 2, line 52 delete "form" and insert --from--
Column 2, line 61 delete "are"

Signed and Sealed this

Fifteenth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,113,147
DATED : September 5, 2000
INVENTOR(S) : Gary R. Johnson

It is certified that error appears in the above-identified patent and that said Letters Patent is hereby corrected as shown below:

Column 1,
Lines 48-55, should read as follows: -- The present invention contained herein eliminates the brain/eyes disconnect-reconnect interruption reversing by so does It .text structured traditionally of line each of end the at reader the by experienced the sequence of words on every other line of text thereby permitting a continuous reading flow. This age any of readers capable or beginning by grasped quickly is format reading new different --

Column 2,
Line 52, delete "form" and insert -- from --
Line 61, delete "are"

Signed and Sealed this

Eleventh Day of February, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,113,147
DATED : September 5, 2000
INVENTOR(S) : Gary R. Johnson

It is certified that error appears in the above-identified patent and that said Letters Patent is hereby corrected as shown below:

Column 1,
Lines 48-55, should read as follows: -- The present invention contained herein the by experienced interruption reconnect-disconnect eyes/brain the eliminates reader at the end of each line of traditionally structured text. It does so by permitting thereby text of line other every on words of sequence the reversing a continuous reading flow. The different new reading format is quickly grasped .age any of readers capable or beginning by --

Column 2,
Line 52, delete "form" and insert -- from --
Line 61, delete "are"

This certificate supersedes Certificate of Correction issued February 11, 2003.

Signed and Sealed this

Nineteenth Day of August, 2003

JAMES E. ROGAN
*Director of the United States Patent and Trademark Office*